US009523507B2

(12) United States Patent
Bruin-Slot et al.

(10) Patent No.: US 9,523,507 B2
(45) Date of Patent: Dec. 20, 2016

(54) METHOD FOR MOUNTING UNDERCABINET VENTILATION HOOD

(71) Applicant: Whirlpool Corporation, Benton Harbor, MI (US)

(72) Inventors: Zachary Jan Bruin-Slot, Baroda, MI (US); Andrew James Grose, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 527 days.

(21) Appl. No.: 13/966,311

(22) Filed: Aug. 14, 2013

(65) Prior Publication Data

US 2015/0047198 A1 Feb. 19, 2015

(51) Int. Cl.
*F24C 15/20* (2006.01)
*F24F 13/02* (2006.01)

(52) U.S. Cl.
CPC ..... *F24C 15/2071* (2013.01); *F24F 13/0254* (2013.01); *Y10T 29/49623* (2015.01); *Y10T 29/51* (2015.01); *Y10T 29/53* (2015.01)

(58) Field of Classification Search
CPC ..... F24C 15/2071; F24C 15/2078; F24C 15/2085; F24C 15/2092; F24C 15/00; F24C 15/205; F24C 15/2035; F24C 15/2042; F24F 13/0254; Y10T 29/51; Y10T 29/53; Y10T 29/49826; Y10T 29/49623
See application file for complete search history.

(56) References Cited

U.S. PATENT DOCUMENTS

| | | | | |
|---|---|---|---|---|
| 510,510 | A | 12/1893 | Johnson | |
| 1,467,781 | A | 9/1923 | Dawson | |
| 2,839,987 | A | 6/1958 | Pryne | |
| 2,887,351 | A | 5/1959 | Allender | |
| 3,098,423 | A * | 7/1963 | Giannini | F24C 15/2071 126/299 D |
| 3,372,632 | A | 3/1968 | Stalker | |
| 3,749,465 | A | 7/1973 | Newcomer | |
| 3,768,064 | A | 10/1973 | Pabich | |
| 4,011,803 | A | 3/1977 | Pfaffinger | |
| 4,154,343 | A | 5/1979 | Lautenschlager et al. | |

(Continued)

FOREIGN PATENT DOCUMENTS

| | | |
|---|---|---|
| CN | 1888577 | 1/2007 |
| DE | 7530601 | 1/1976 |

(Continued)

*Primary Examiner* — Sarang Afzali

(57) ABSTRACT

A ventilation hood is mounted to an underside of a cabinet by left and right support brackets each including a main body from which depend at least one support tab or hanger, as well as a locator tab. The main body is aligned on the cabinet, while the locator tab appropriately spaces the support bracket from an upstanding rear wall. Thereafter, the ventilation hood is positioned so the support tabs are received in slots formed in a top panel of the hood and, upon sliding the hood rearward, the hood rides upon ramped or tapered surfaces of the support tabs to position the hood against the cabinet while hanging the hood from the support tabs. Thereafter, the support tabs are bent to retain the ventilation hood in an operational position. Employing the distinct aligning, positioning and hanging structure enables a single person to readily mount the ventilation hood.

19 Claims, 5 Drawing Sheets

(56) References Cited

U.S. PATENT DOCUMENTS

| | | | |
|---|---|---|---|
| 4,437,712 | A | 3/1984 | Wissinger |
| 4,453,690 | A | 6/1984 | Takeuji |
| 4,465,256 | A | 8/1984 | Wolbrink et al. |
| 4,576,355 | A | 3/1986 | Graf |
| 4,580,853 | A | 4/1986 | Hitzeroth et al. |
| 4,614,177 | A | 9/1986 | Buckley et al. |
| 4,628,185 | A | 12/1986 | Norwood et al. |
| 4,630,532 | A | 12/1986 | Sonnentag et al. |
| 4,666,113 | A | 5/1987 | Itoh et al. |
| 4,753,406 | A | 6/1988 | Kodama et al. |
| 4,775,273 | A | 10/1988 | Bauer |
| 4,792,195 | A | 12/1988 | Adriaansen et al. |
| 4,796,850 | A | 1/1989 | Aramaki |
| 4,824,061 | A | 4/1989 | Sumikama et al. |
| 5,207,543 | A | 5/1993 | Kirma |
| 5,333,827 | A | 8/1994 | Gioscia |
| 5,775,319 | A | 7/1998 | Pettinari |
| 5,887,388 | A | 3/1999 | Hempel et al. |
| 6,341,754 | B1 | 1/2002 | Melito et al. |
| 6,444,954 | B1 | 9/2002 | Blankenship |
| 7,222,925 | B2 | 5/2007 | Yu et al. |
| 7,654,258 | B2 | 2/2010 | Negandhi et al. |
| 7,780,128 | B2 | 8/2010 | Walsberg |
| 8,272,377 | B2 | 9/2012 | Tsakiris |
| 2005/0246989 | A1 | 11/2005 | Pringle et al. |
| 2006/0042622 | A1 | 3/2006 | Searer |
| 2007/0256681 | A1 | 11/2007 | Chiang |
| 2008/0184538 | A1 | 8/2008 | Shellnutt |
| 2008/0302352 | A1 | 12/2008 | Pearce |
| 2009/0103999 | A1 | 4/2009 | Fucito |

FOREIGN PATENT DOCUMENTS

| | | | | |
|---|---|---|---|---|
| DE | 34 17 453 | | 11/1985 | |
| DE | EP 1632723 | A1 * | 3/2006 | ..... F24C 15/2071 |
| DE | 202012008040 | | 9/2012 | |
| DE | 102011051104 | | 11/2012 | |
| EP | 1621819 | | 2/2006 | |
| EP | 1939538 | | 7/2008 | |
| EP | 2229846 | A1 | 9/2010 | |
| EP | 2546578 | | 1/2013 | |
| FR | 2766112 | | 1/1999 | |
| JP | 4897234 | | 11/1973 | |
| JP | 02126038 | | 5/1990 | |
| JP | 1151436 | | 2/1999 | |
| JP | 2006153395 | | 6/2006 | |

* cited by examiner

METHOD FOR MOUNTING UNDERCABINET VENTILATION HOOD

BACKGROUND OF THE INVENTION

Field of the Invention

The present invention pertains to the art of cooking and, more particularly, to a system and method for mounting a ventilation hood under cabinetry positioned above a cooking appliance.

Description of the Related Art

In the art of cooking, numerous types of cooking appliances are known, including both slide-in and drop-in ranges. Basically, both types of ranges are designed to be situated in a space or cut-out provided along a length of a kitchen countertop. In either case, the range includes at least one oven cavity supported below a cooktop. Of course, it is also known to separately mount cooktops, without lower oven cavities, in countertops. In any case, when the cooktop is utilized for cooking operations, a certain degree of smoke, grease or the like can be created. To counter the airborne nature of these byproducts, it is known to mount a ventilation unit above the range. Basically, such known ventilation units include an exhaust fan which functions to draw the smoke and other byproducts away from the cooktop. The byproducts are typically either directed to a vent external of the cooking area or filtered such that the cleansed air is simply expelled back into the cooking area. Such known ventilation units can take the form of a ventilation hood or can be incorporated into an overhead microwave oven mounted above the range. In many situations, the ventilation unit will also incorporate a light to aid in illuminating the cooktop.

In mounting a ventilation unit incorporated into a microwave oven to the bottom of a cabinet which is centered above and spans the appliance, it is commonplace to bolt the ventilation unit to a bottom cabinet panel. More specifically, a housing of the microwave oven is provided with spaced front and rear mounting holes and a template can be provided which enables an installer to mark drilling locations in the bottom panel of the cabinet, with the intent that the drilled holes will be aligned with pre-formed mounting holes in the unit. Assuming the proper alignment exists, the microwave oven can be held in a position beneath the upper cabinet and bolts inserted through each of the aligned hole sets to secure the microwave oven in place. In the case of a ventilation hood, the housing of the hood is typically used as a template for determining appropriate fastener locations and then filler strips are measured, cut and installed beneath the cabinet to complete lower framing needed to mount the ventilation hood.

Certain problems are considered to exist in each of these overall mounting arrangements. First of all, at least in the case ventilation units incorporated in microwave ovens, it is common for the template to take the form of a folded paper template which must be unfolded, cut to fit the underside of the upper cabinet and taped or otherwise retained in position to establish the drilling locations. Given that creases and improper cuts can contribute to misalignment issues, it is not uncommon for product manufacturers to recommend that significantly larger holes be drilled than needed to receive the bolts, and washers are provided to accommodate the enlarged holes. In this manner, a degree of tolerance is established to better assure potential alignment of each bolt with a designated hole in the ventilation unit. In the case of ventilation hoods, the measuring, cutting and mounting of filler strips can be quite tedious and time consuming, particularly if a professional installer is not employed. In both types of mounting arrangements, a second significant problem is that, after the holes are drilled and it is time to actually secure the ventilation unit, two people are required, one for holding the ventilation unit in place and the other for inserting and tightening at least a couple of the bolts. Certainly, given the confined space and the need to hold the unit around eyelevel for some time, this operation is less than desirable.

Although two people may be necessary for mounting a microwave, it is desired in accordance with the present invention to provide a method which enables a single user to readily install a ventilation hood over a cooking appliance through the use of a simplified and efficient installation system.

SUMMARY OF THE INVENTION

The present invention is directed to a system and method for mounting a ventilation hood above a cooking appliance and under a cabinet, such as in a kitchen. In general, the system employs a pair of support brackets mounted to the underside of the cabinet at laterally spaced, left and right positions, with each support bracket including distinct aligning, positioning and hanging structure which enables a single person to readily mount the ventilation hood to the cabinet. More specifically, each support bracket includes a main body from which depend at least one and, more preferably, first and second longitudinally spaced support tabs or hangers, as well as a locator tab. Alignment structure enables the main body to be easily positioned for mounting to the cabinet in a requisite manner, while the locator tab assures that the support bracket is positioned a required distance from a rear wall extending behind the cabinet. Once the support brackets are properly positioned, aligned and mounted, the ventilation hood can be positioned so that the support tab(s) is/are received in one or more slots formed in a top panel of the hood and, upon sliding the ventilation hood rearward, the hood rides upon ramped or tapered surface of each support tab to position the hood against the cabinet while hanging the hood from the support tab(s). Thereafter, the support tab(s) can be bent to retain the ventilation hood in an operational position. If desired, a mechanical fastener can be employed to secure each bent support tab to the ventilation hood.

In accordance with a further aspect of the invention, the support brackets are configured for use in mounting a ventilation hood beneath a frameless cabinet, i.e., a cabinet having supports above the bottom panel. In this situation, each support bracket is provided with one or more support tabs or hangers which project perpendicular to the main body. The main body is again aligned, either visually or through the use of spacers and positioned from the rear wall by the locator tab. In connection in a universal support bracket arrangement, the support tab(s) employed with mounting the ventilation hood on a cabinet including a lower frame can be used as the lateral spacers. In any case, once the support brackets appropriately mounted, a corresponding hanging and securing operation for the ventilation hood can be readily effected by a single person.

Additional objects, features and advantages of the invention will become readily apparent from the following detailed description of preferred embodiments of the invention when taken in conjunction with the drawings wherein like reference numerals refer to corresponding parts in the several views.

DETAILED DESCRIPTION OF PREFERRED EMBODIMENTS

Figure 1:
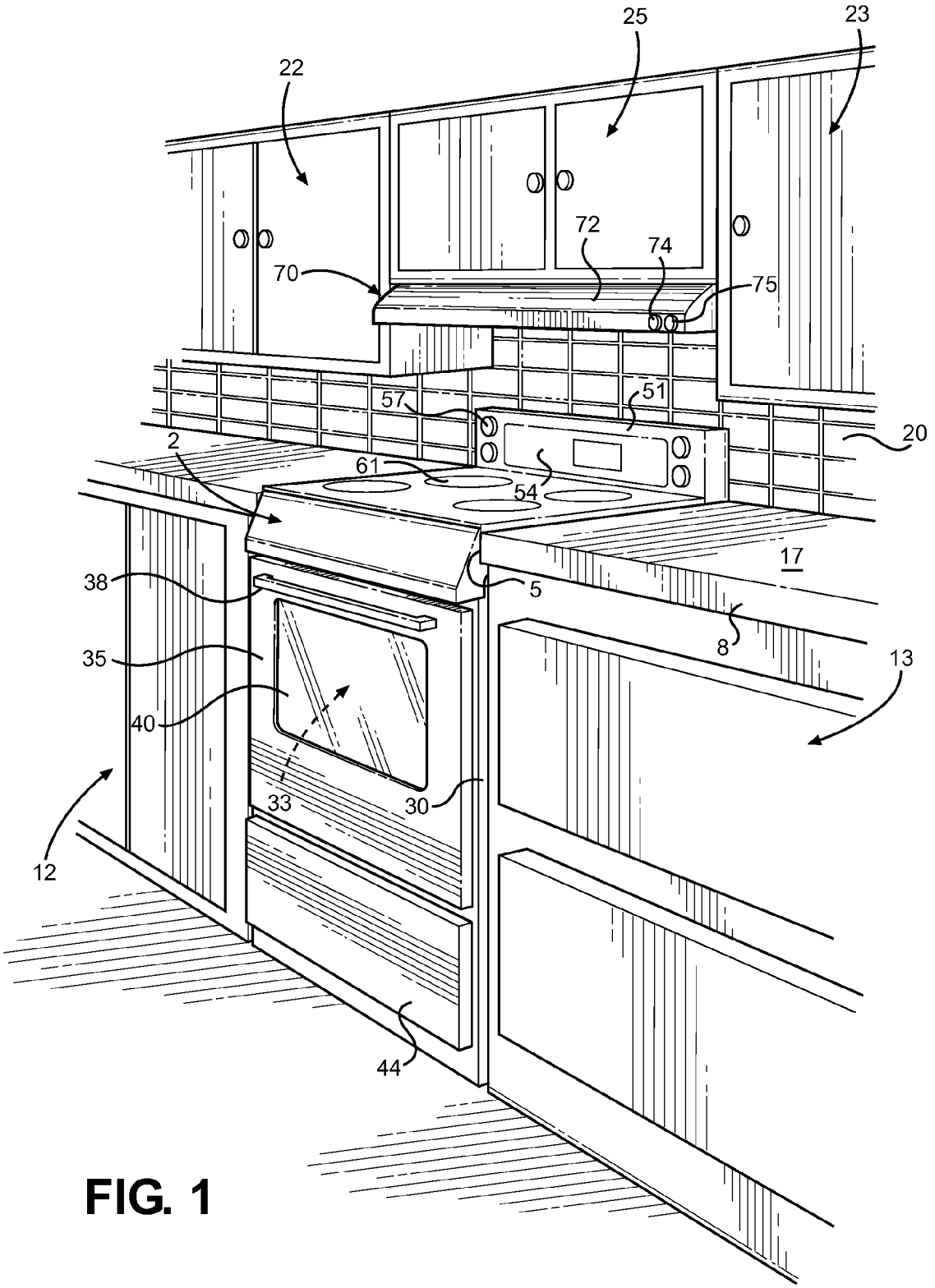
FIG. 1 is a perspective view illustrating a ventilation hood mounted in accordance with the invention to cabinetry positioned above a range in a kitchen environment.

With initial reference to FIG. 1, a cooking appliance 2 is shown positioned in a cut-out or opening 5 provided in a countertop 8 and between adjacent lower cabinetry 12 and 13. Countertop 8 has an upper surface 17 extending to a rear upstanding wall 20. Above countertop 8 are shown wall cabinets 22 and 23 mounted on either side of cooking appliance 2, as well as a central cabinet 25 arranged above at least a portion of cooking appliance 2 and between cabinets 22 and 23.

Within the scope of the invention, cooking appliance 2 can take on various forms, including all fuel type ranges and built-in cooktops. However, in the exemplary embodiment illustrated, cooking appliance 2 is illustrated as a range including a cabinet or shell 30 which supports an oven cavity 33 located behind a door 35 having a handle 38 and a window 40. In a manner known in the art, door 35 can be pivoted to access oven cavity 33. Also, as shown, cooking appliance 2 includes a lower drawer 44 for use in storing pans and the like. In addition, cooking appliance 2 includes an upper control panel 51 having a central oven control section 54. Furthermore, control panel 51 is shown provided with a plurality of control knobs, one of which is indicated at 57, for regulating operation of upper cooktop heating elements or burners, such as that indicated at 61.

Particularly with the inclusion of the heating elements or burners 61, operation of cooking appliance 2 can produce smoke, grease or other airborne byproducts. To counter the potential detrimental effects of these cooking byproducts, it is desired to mount a ventilation hood 70 above cooking appliance 2, specifically to the underside of central cabinet 25 and between side wall cabinets 22 and 23, to draw in and either exhaust or filter and re-direct the associated flow of air. Certainly, ventilation hoods employed for this purpose are known in the art, but the present invention is particularly directed to a system and method for mounting ventilation hood 70, specifically a mounting arrangement which enables a single installer to readily and efficiently secure ventilation hood 70 to central cabinet 25.

Figure 2:
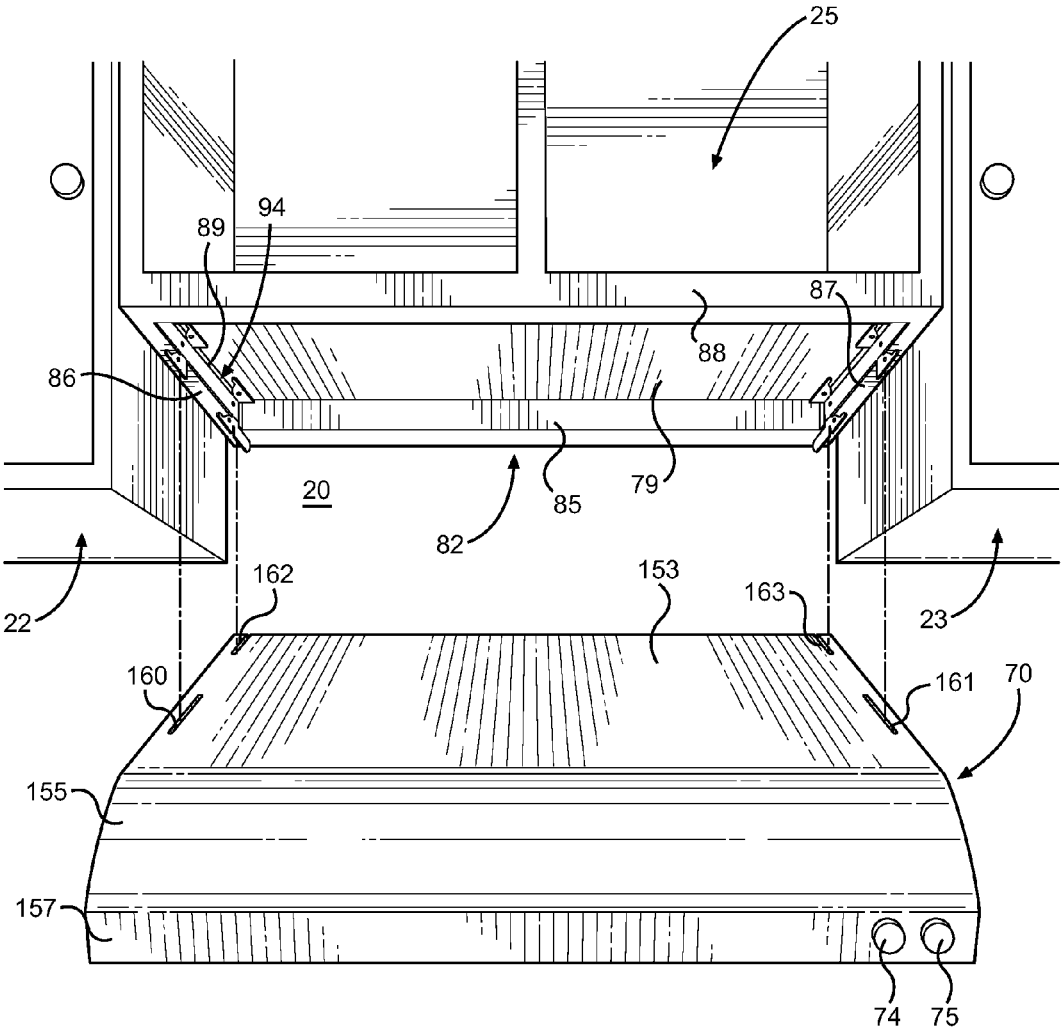
FIG. 2 is a partial exploded view of a first stage in the mounting of the ventilation hood of FIG. 1 in accordance with the invention.

In general, the operation of ventilation hood 70 is also known in the art. Therefore, apart from particular details set forth hereinafter, it should be recognized that the actual construction of ventilation hood 70 can vary from that depicted. Therefore, although ventilation hood 70 is shown to include a housing 72 and control knobs 74 and 75 for a fan and light (not shown) respectively, the invention is equally applicable to a wide range of other configurations. In connection with the mounting of ventilation hood 70, it should also be recognized that central cabinet 25 is also of known construction. That is, although the exact materials and construction can vary, central cabinet 25, as shown in FIG. 2, includes a bottom panel or floor 79 and, in this depicted embodiment, a lower support frame 82, shown to include a rear flange piece 85, opposing side flange pieces 86 and 87, and a front flange piece 88. Each of rear, side and front flange pieces 85-88 defines a side portion as exemplified by side portion 89 for side flange piece 86.

Figure 3:
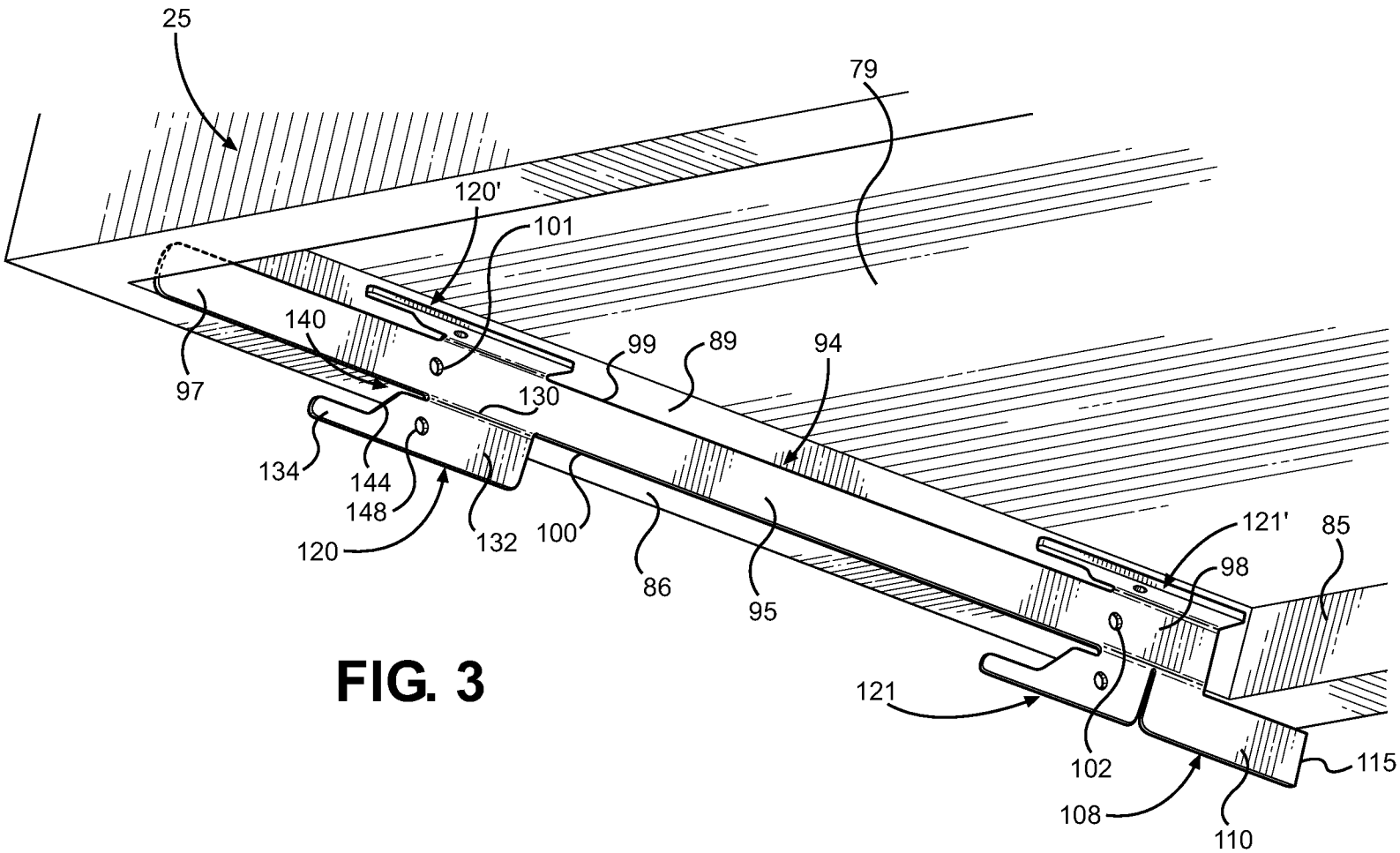
FIG. 3 is a perspective view of an under cabinet support bracket mounting configuration employed in the invention.

In accordance with one aspect of the invention, support brackets are initially mounted at spaced locations beneath central cabinet 25, i.e., to the underside of cabinet 25. As the support brackets for the opposing sides of cabinet 25 are mirror images of each other, a detailed description of one side support bracket will now be made and it is to be understood that corresponding structure exists in connection with the other side bracket. More particularly, for the left side of cabinet 25 as shown in FIGS. 2 and 3, a support bracket 94 is shown to include an elongated main body 95 taking the form of a plate having a front end portion 97 and a rear end portion 98 which are longitudinally spaced, as well as an upper edge 99 and a lower edge 100. In or adjacent each end portion 97, 98, elongated main body 95 is provided with spaced holes 101 and 102 respectively. In addition, depending from rear end portion 98 of elongated main body 95 is a locator tab 108 which includes a locator extension 110 having a terminal end 115. As shown, locator extension 110 extends below and generally parallel to elongated main body 95.

Also depending from elongated main body 95 at spaced longitudinal positions are first and second support tabs or hangers 120 and 121. Each of first and second support tabs 120, 121 is generally established by a connection section 130 securing the support tab 120, 121 along lower edge 100 of main body 95, a main section 132, and a cantilevered projection or finger section 134. As clearly illustrated in FIG. 3, between connection section 130 and finger section 134, main body 95 extends for a certain distance spaced from main body 95 such that a slit or recess 140 is established, with slit 140 opening toward finger section 134 and terminating at connection section 130. From slit 140, main body 95 leads to finger section 134 through a tapered or ramped section 144. For reasons which will become more fully evident below, both finger section 134 and slit 140 are sized based on the thickness of the material of housing 72 of ventilation hood 70. Finally, provided within main section 132 is a hole 148. Again, second support tab 121 is similarly constructed to first support tab 120 such that a reiterative description will not be made here. However, it should be noted that, although the various longitudinal dimensions of the various sections of the support tabs 120 and 121 can vary (for instance the main section of support tab 121 is shown to be shorter than the main section of support tab 120), the embodiment depicted illustrates the respective finger sections 134 and slits 140 to have substantially corresponding dimensions.

In the embodiment shown, support bracket 94 is made of sheet metal which is stamped to create each of main body 95, locator tab 108 and first and second support tabs 120 and 121. In addition, although other materials could be employed, housing 72 of ventilation hood 70 is also formed of sheet metal and, as best shown in FIG. 2, includes a top panel 153, a sloping section 155 and a front panel 157 created by bending and shaping a piece of sheet metal. For use in mounting ventilation hood 70, top panel 153 is formed with a pair of spaced, front slots 160 and 161, as well as a pair of spaced, rear slots 162 and 163. As will be detailed more fully below, each pair or set of front and rear slots 160 and 162, 161 and 163 on each side of top panel 153 partially receives a respective support tab 120, 121 for mounting of ventilation hood 70.

In connection with the invention, it is recognized that the outer lateral dimension of lower support frame 82 is standard based on the distance between wall cabinets 22 and 23. Obviously, ventilation hood 70 is dimensioned and manufactured accordingly. However, based on electrical or other issues, the depth of cabinet 25 may not be the same as cabinets 22 and 23. Still, given that the positioning of slots 160-163 are pre-established upon manufacturing of ventilation hood 70, uniformity in the positioning of support brackets 120 and 121 from rear wall 20 is crucial in addressing mounting alignment issues. With this information in mind, the first step in connection with the mounting method for ventilation hood 70 is to mount first and second support brackets 94 to lower support frame 82 and at predetermined positions relative to both rear wall 20 and side flange portions 86 and 87. More specifically, as exemplified by the left side mounting arrangement of these figures, support bracket 94 is mounted to side flange portion 86 by placing main body 95 against side portion 89, aligning lower edge 100 so as to be flush with a bottom of side flange portion 86 and abutting terminal end 115 of locator extension 110 with rear wall 20. Once properly positioned in this matter, mechanical fasteners, such as wood screws (not shown), are inserted into holes 101 and 102 and driven into side flange portion 86. This same process is then performed for side flange portion 87 such that two fore-to-aft extending support brackets 94 are mounted at spaced locations beneath cabinet 25 with finger sections 134 of support tabs 120 and 121 projecting forward or away from rear wall 20.

Figure 4:
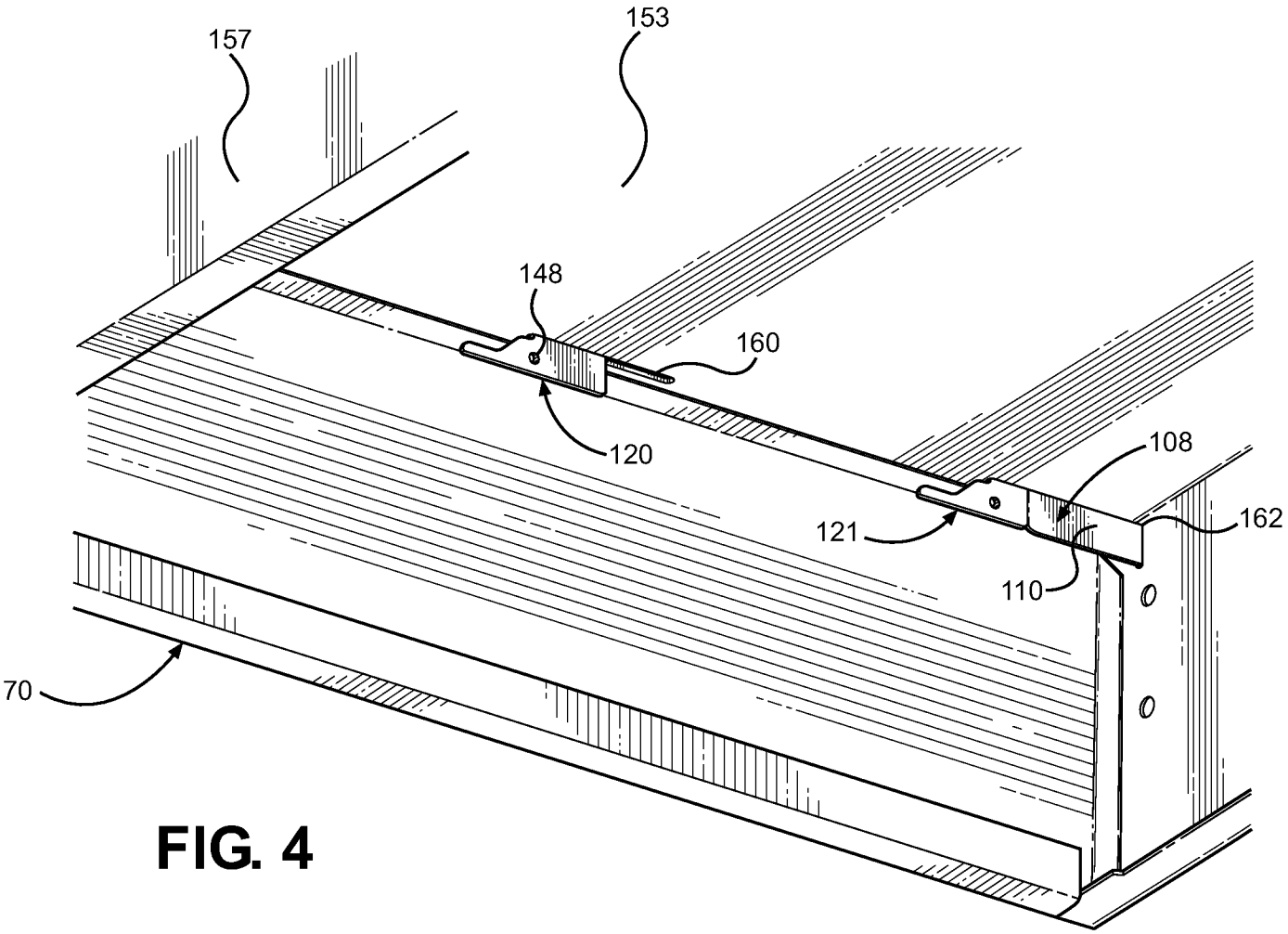
FIG. 4 is a lower perspective view of the ventilation hood of FIG. 1 in an initial mounting stage.
Figure 5:
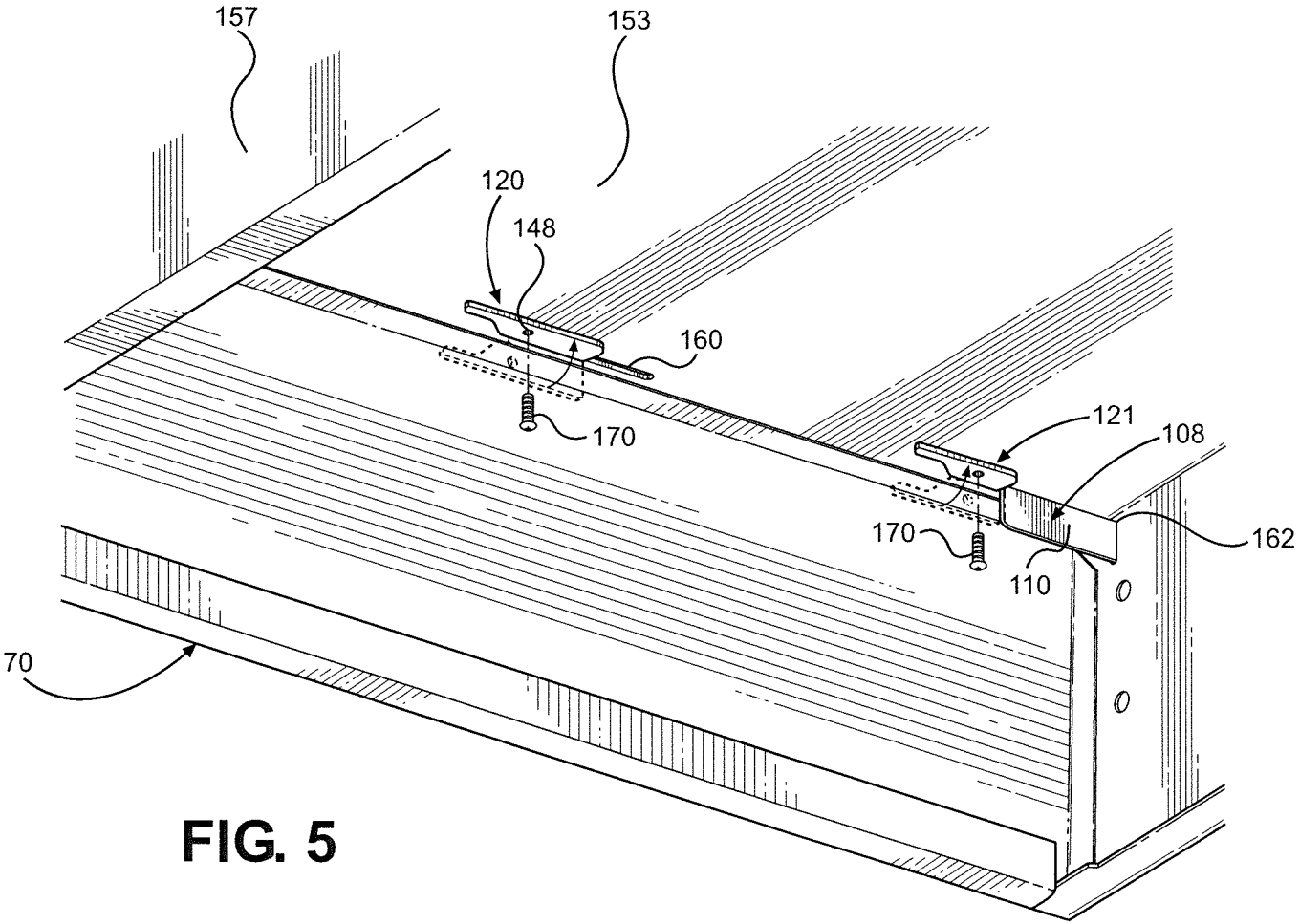
FIG. 5 is a lower perspective view of the ventilation hood in a final mounting stage.

At this stage, ventilation hood 70 can be hung from the spaced support brackets 94 by aligning the respective support tabs 120 and 121 on each side of cabinet 25 with a respective pair of front and rear slot 160 and 162, 161 and 163 on each side of top panel 153, inserting each support tab 120, 121 into a respective slot 160-163 and then shifting ventilation hood 70 rearward. With this rearward shifting, a portion of top panel 153 will be received with a respective slit 140 as shown in FIG. 4. During this rearward movement, each tapered section 144 ramps and guides the movement, thereby forcing ventilation hood 70 upward during the rearward shifting and assuring that ventilation hood 70 abuts snugly against cabinet 25. At the same time, a portion of each locator tab 108 is also accommodated in a respective rear slot 162, 163 as slots 162 and 163 open out the back panel (not separately labeled) of ventilation hood 70. Thereafter, each support tab 120, 121 is bent upward against top panel 153 along a respective connection section 130 to assume the position shown in FIG. 5. At this point, aside from any potential electrical issues, the assembly can be considered complete, with ventilation hood 70 being in an operational position. However, it is also proposed in accordance with the invention to provide a further securing feature by enabling one or more mechanical fasteners 170, such as metal screws, to extend through hole(s) 148 and into top panel 153.

In the embodiment described above, cabinet 25 is provided with lower support frame 82. However, another standard type of cabinet is frameless such that the lowermost exposed portion would correspond to bottom panel 79. To accommodate use of the invention with this type of known cabinet, each support bracket 94 would include support tabs 120' and 121' (see FIG. 3) which are connected to main body 95 along edge 99 at right angles, i.e. perpendicular, to both support tabs 120 and 121 and main body 95. As support tabs 120' and 121' are identically configured to support tabs 120 and 121, the structure thereof will not be repeated. However, for use with this type of cabinet, it should be recognized that support bracket 94 is rotated so that main body 95 is flat against bottom panel 79, support brackets 120 and 121 are arranged flush with outermost portions of the cabinet so as to act as spacers which position main body 95 a requisite distance from an outermost lateral edge of cabinet 25 (i.e., a distance equal to the standard thickness of side flange portion 86 or 87), terminal end 115 again abuts rear wall 20 at a height commensurate with main body 95 and ventilation hood 70 is then hung from support tabs 120' and 121' in a manner directly corresponding to that set forth above. Certainly, support tabs 120' and 121' are not needed if mounting ventilation hood 70 to cabinet 25 with lower support frame 82 and the function of support tabs 120 and 121 when utilizing support bracket 94 with a frameless cabinet could be performed by structure lacking at least finger section 134, slit 140, tapered section 140 and hole 148. In addition, even with cabinets lacking lower support frame 82, an outline of the frame to which lower panel 79 is attached can typically be seen so a visual alignment of main body 95 is possible. In any case, when support brackets 94 are structured in the manner illustrated in the figures, it should be apparent that a universal bracket is established in accordance with the invention to enable the mounting of ventilation hood 70 with either type of known cabinetry.

Although described with respect to preferred embodiments of the invention, it should be readily apparent that various changes and/or modifications can be made to the invention without departing from the spirit thereof. For instance, it should be readily apparent that the invention can employ various different fastener assemblies in connection with an overall system and method for mounting a ventilation hood to an underside of a cabinet, including frame-type and frameless cabinets. In addition, although the embodiments described above reference two support tabs on each bracket, it should be recognized that a single, elongate support tab establishing an elongated slit or recess, or more than two support tabs on each bracket, could be employed. In any case, it should be recognized that each configuration provides for the use of support brackets employing distinct aligning (vertically and/or laterally), positioning (fore-to-aft relative to a rear wall) and hanging features which enables a ventilation hood to be mounted in an easy and efficient manner by a single person, without the need for measuring, cutting and installing filler strips as common in the art.

We claim:

1. A method of mounting a ventilation hood to an underside of a cabinet positioned along a rear wall above a cooking appliance comprising:

securing first and second brackets to the underside of the cabinet at spaced positions, with each of the first and second brackets including a locator tab abutting the rear wall and at least one support tab extending below the cabinet;

inserting each support tab into a respective slot provided in a top panel of the ventilation hood; and shifting the ventilation hood rearward, causing portions of the top panel of the ventilation hood to be received within slits established between the support tabs and main body portions of the first and second brackets, wherein the ventilation hood is hung from the first and second brackets.

2. The method of claim 1, further comprising: guiding the ventilation hood during rearward shifting along ramped sections formed on the support tabs.

3. The method of claim 2, wherein guiding the ventilation hood includes forcing the ventilation hood upward during rearward shifting such that the ventilation hood abuts the cabinet.

4. The method of claim 2, wherein inserting the support tabs into the slots provided in the top panel of the ventilation hood initially includes inserting finger sections of the support tabs into the slots, with the finger sections leading to the ramped sections.

5. The method of claim 1, further comprising: securing the ventilation hood by bending the support tabs against the top panel.

6. The method of claim 5, further comprising: additionally securing the ventilation hood by mechanically fastening the support tabs to the top panel.

7. The method of claim 5, wherein each of the support tabs is connected to one of the first and second brackets through a connection section and bending the support tabs constitutes bending along a respective said connection section.

8. The method of claim 1, wherein securing the first and second brackets to the underside of the cabinet includes mechanically fastening the main body of each of the first and second brackets directly to a bottom panel of the cabinet and abutting the locator tab constitutes engaging a terminal end of the locator tab with the rear wall at a height commensurate with the main body.

9. The method of claim 8, further comprising: employing additional support tabs extending from the first and second brackets as spacers to position the first and second brackets relative to the bottom panel for mechanical fastening purposes.

10. The method of claim 1, wherein at least one of the slots provided in the top panel of the ventilation hood extends into a back panel of the ventilation hood such that inserting the support tabs into the slots and shifting the ventilation hood rearward causes at least the locator tab to extend through the back panel.

11. The method of claim 1, wherein inserting the support tabs into the slots provided in a top panel of the ventilation hood includes inserting multiple, fore-to-aft spaced support tabs into multiple slots on each lateral side of the ventilation hood.

12. The method of claim 1, wherein securing the first and second brackets to the underside of the cabinet includes mechanically fastening the first and second brackets to side support flanges of a lower support frame of the cabinet and abutting the locator tab constitutes engaging a terminal end of the locator tab with the rear wall at a position below the lower support frame.

13. The method of claim 1, wherein the ventilation hood is shifted rearward after the support tabs are inserted into the slots.

14. A method of mounting a ventilation hood to an underside of a cabinet positioned along a rear wall above a cooking appliance comprising:

mounting first and second brackets, each including distinct aligning, positioning and hanging structure, to the underside of the cabinet at laterally spaced positions, with the aligning and positioning structure being employed to locate each of the first and second brackets relative to the cabinet prior to mounting;

hanging the ventilation hood from the hanging structure of the first and second brackets; and rearwardly shifting the ventilation hood, causing the hood to be forced upward to the underside of the cabinet, wherein:

the aligning structure locates the first and second brackets vertically or laterally with respect to the underside of the cabinet;

the positioning structure abuts the rear wall to position the first and second brackets relative to the rear wall; and the hanging structure establishes ramps which force the ventilation hood upward upon being rearwardly shifted and slits within which portions of to panel of the ventilation hood are received.

15. The method of claim 14, wherein:

the positioning structure includes a locator tab abutting the rear wall and the hanging structure includes at least one support tab extending below the cabinet;

hanging the ventilation hood from the hanging structure includes inserting each support tab into a respective slot provided in a top panel of the ventilation hood; and at least one of the slots provided in the top panel of the ventilation hood extends into a back panel of the ventilation hood such that inserting the support tabs into the slots and shifting the ventilation hood rearward causes at least the locator tab to extend through the back panel.

16. The method of claim 14, wherein:

the positioning structure includes a locator tab abutting the rear wall; and securing the first and second brackets to the underside of the cabinet includes mechanically fastening the first and second brackets to side support flanges of a lower support frame of the cabinet and abutting the locator tab constitutes engaging a terminal end of the locator tab with the rear wall at a position below the lower support frame.

17. The method of claim 14, wherein:

the hanging structure includes at least one support tab extending below the cabinet;

hanging the ventilation hood from the hanging structure includes inserting each support tab into a respective slot provided in a top panel of the ventilation hood; and the ventilation hood is shifted rearward after the support tabs are inserted into the slots.

18. The method of claim 14, wherein:

the hanging structure includes at least one support tab extending below the cabinet; and rearwardly shifting the ventilation hood causes portions of a top panel of the ventilation hood to be received within the slits established between the support tabs and main body portions of the first and second brackets.

19. A method of mounting a ventilation hood to an underside of a cabinet positioned along a rear wall above a cooking appliance comprising:

mounting first and second brackets, each including distinct aligning, positioning and hanging structure, to the underside of the cabinet at laterally spaced positions, with the aligning and positioning structure being employed to locate each of the first and second brackets relative to the cabinet prior to mounting, wherein the positioning structure includes a locator tab abutting the rear wall and the hanging structure includes at least one support tab extending below the cabinet;

hanging the ventilation hood from the hanging structure of the first and second brackets by inserting each support tab into a respective slot provided in a top panel of the ventilation hood; and rearwardly shifting the ventilation hood, causing portions of the top panel of the ventilation hood to be received within slits established between the support tabs and main body portions of the first and second brackets and causing the hood to be forced upward to the underside of the cabinet.

* * * * *